United States Patent [19]

Bonnel

[11] 4,157,889

[45] Jun. 12, 1979

[54] BURNER FOR POWDERED FUEL

[75] Inventor: Michel G. Bonnel, Comines, France

[73] Assignee: Societe Colmant Cuvelier, Lille, France

[21] Appl. No.: 787,166

[22] Filed: Apr. 13, 1977

[30] Foreign Application Priority Data

Apr. 16, 1976 [FR] France ..... 76 11316
Dec. 22, 1976 [FR] France ..... 76 38687

[51] Int. Cl.[2] ..... F23M 9/00

[52] U.S. Cl. ..... 431/182; 110/263; 431/8

[58] Field of Search ..... 431/284, 285, 158, 174, 431/183, 182, 8, 184, 185; 110/22 R, 22 A, 28 A, 263, 264, 265; 239/399, 404, 405, 400

[56] References Cited

U.S. PATENT DOCUMENTS

| | | | |
|---|---|---|---|
| 2,921,542 | 1/1960 | Kidwell et al. | 110/265 |
| 3,049,085 | 8/1962 | Musat et al. | 431/183 |
| 3,147,795 | 9/1964 | Livingston et al. | 431/284 X |
| 3,729,285 | 4/1973 | Schwedersky | 431/284 X |
| 3,894,834 | 7/1975 | Estes | 431/8 X |
| 3,915,387 | 10/1975 | Caruel | 239/404 |

FOREIGN PATENT DOCUMENTS

| | | | |
|---|---|---|---|
| 308054 | 3/1929 | United Kingdom | 110/22 A |
| 298080 | 8/1929 | United Kingdom | 110/22 A |
| 323578 | 1/1930 | United Kingdom | 110/22 A |

*Primary Examiner*—Edward G. Favors
*Attorney, Agent, or Firm*—Darby & Darby

[57] ABSTRACT

The invention comprehends a burner for powdered fuel comprising an annular conduit for the injection of solid fuel in powder form, included between two coaxial conduits for the injection of air, one internal and the other external in which the three conduits discharge into an expansion and stabilization chamber which is formed by a divergent truncated portion connected to the external air injection conduit and which also has a central cylindrical portion and a terminal convergent truncated portion.

22 Claims, 5 Drawing Figures

BURNER FOR POWDERED FUEL

The present invention relates to a burner for a powdered fuel.

Its object is mainly to provide a burner enabling the heating of boilers using, instead of a liquid fuel such as fuel oil, dry waste products reduced to a powder, the burning temperature of which can be of the order of 100° to 580° C. Among the waste products which are very prevalent and consequently cheap and which may be used are wood waste, straw waste, dead leaves, textile waste, and all other wastes having a heating capacity and being capable of reduction to a powder.

Reduced to powder, means that these wastes have been ground by any appropriate means, in mills for example, so as to be reduced to very fine particles, for example of a diameter of the order of 300 microns so that they may be ignited in an almost instantaneous manner at the outlet from the burner pipe.

It is know to use solid powdered fuels such as pulverised carbon or sawdust but in all the known devices the fuel is not ignited instantaneously. This fact requires means for pre-heating these particles so as to bring them to a temperature sufficiently high for them to be ignited.

These means include either, in introducing the particles into the fire along a predetermined passage during the course of which they are heated by the proximity of the flame, or in lining the walls of the fire box with refractory materials so as to obtain a fire of the type known as a high temperature fire such that the particles are heated by the heat radiated by the walls. Another approach is in transporting the powdered fuel in a hot current of air so that the particles are pre-heated.

In the first case, the means for obtaining a progressive reheating are usually quite complex. In the second case it can happen that a large mass of non-ignited fuel fills the fire box and is ignited all at once, which can an explosion. In the third case, the preheating of the air, apart from the fact that it involves additional expenses which considerably reduce the economic effectiveness in these burners, presents serious fire hazards.

The burner according to the present invention must be capable of operating as a replacement for a liquid or gaseous fuel burner. That is to say it must be adaptable to any boiler operating normally with burners of known type without modification of the boiler. Furthermore the air serving to transport the powdered combustible product must be capable of being at the ambient temperature. Also, the fire box of the boiler must be a fire box of the type known as a low temperature fire box, that is to say not comprising walls covered with refractory materials.

It is known, particularly from French Pat. No. 941,398 of Feb. 5, 1947, to provide these burners for powdered fuels by arranging three concentric conduits, the conduit transporting the air and the powdered fuel in suspension in the flow of air, being arranged between two air injection conduits. However, these burners do not enable instantaneous and regular combustion of the powdered fuel to be obtained and require the use of additional means such as an additional injection of liquid fuel or preheating means.

The burner in accordance with the present invention includes an annular conduit for the injection of solid fuel in powdered form, included between two coaxial air injection conduits, one inside and the other outside the annular conduit. The three conduits discharge into a chamber for the expansion and stabilization of the flame which chamber has a divergent portion, a central cylindrical portion and a convergent portion.

Other characteristics will become apparent from the following description of a non-limiting embodiment of the invention, accompanied by drawings in which.

Figures 1, 2:
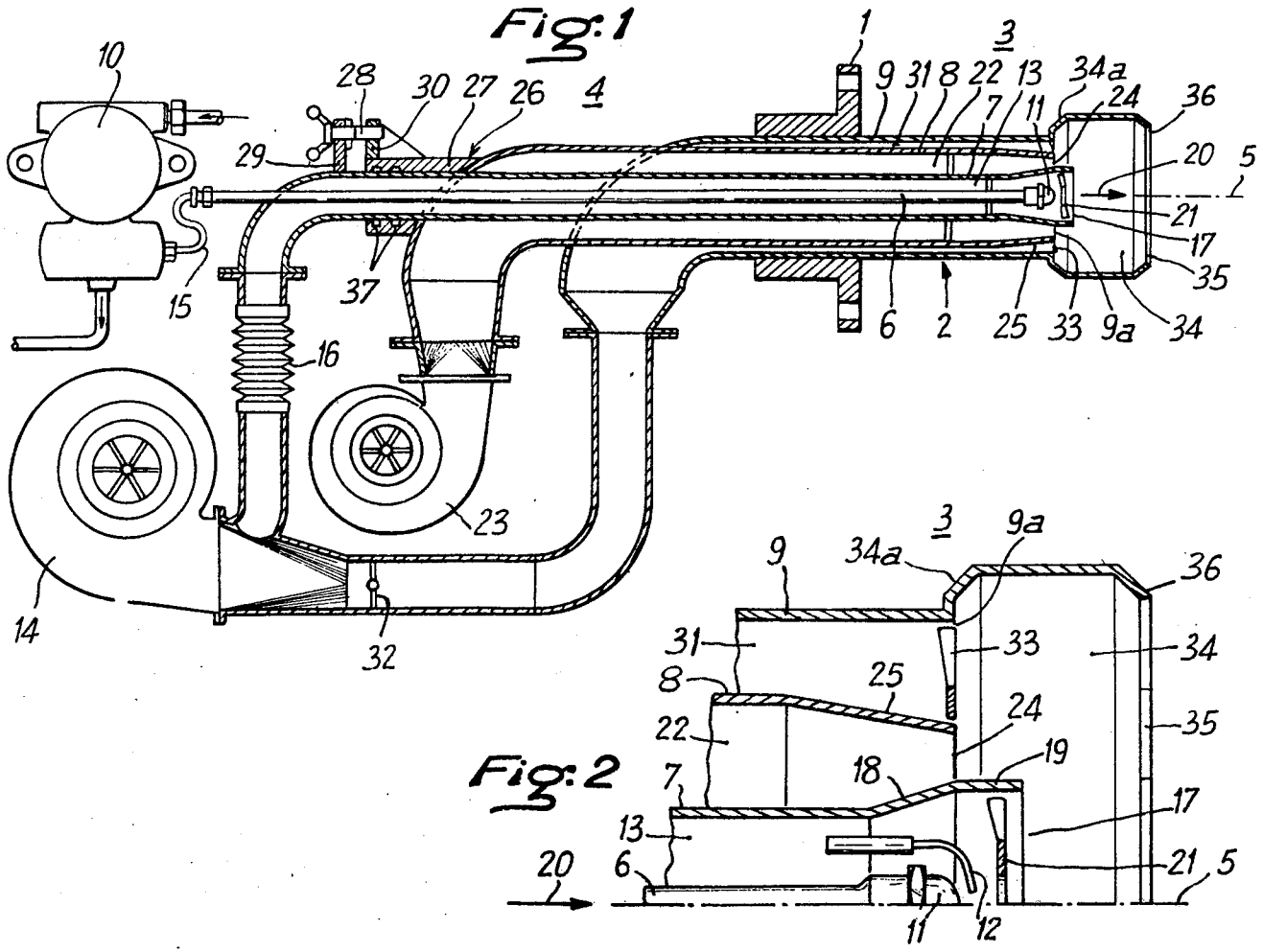
FIG. 1 shows a view of a burner assembly according to the invention in partial section through a generally vertical plane of symmetry of the conduits.
FIG. 2 shows a detail of FIG. 1 illustrating the arrangements provided by the burner in the vicinity of the outlet from the different conduits into the combustion chamber of the boiler.

In the various descriptions, "primary air" denotes the air which serves for the pneumatic transport of the fuel and "secondary air" denotes additional air.

In the embodiment described, the boiler is not represented. However, the reference 1 on the generally cylindrical outer periphery of the assembly 2 of the injection conduits, shows the ring serving to connect the burner to the wall of the boiler. Thus, this ring 1 locates the interior 3 of the combustion chamber of the boiler and 4 designates the exterior where the feed pumps for fuel and for air are arranged as well as the means for regulating the flame.

These figures show that the injection assembly 2 penetrating into the interior 3 of the boiler is formed by four essentially cylindrical tubes which are concentric about an axis 5, in this instance horizontal. The tubes bear the references 6, 7, 8 and 9 in order of increasing diameter.

At the exterior 4 of the boiler, the tube 6 is connected to a liquid fuel pump 10 and terminates in an injection nozzle 11 of known type, at the level of which are disposed two liquid fuel ignition electrodes such as 12 (FIG. 2), this portion operating by liquid fuel only being used for the initial ignition of the waste as it leaves the burner.

The tube 7 immediately surrounding the tube 6, defines with the latter a conduit 13 connected to means for supplying air under pressure constituted in this instance by a variable speed blower 14. The integral assembly formed by the tube 6, its nozzle 11 and by the tube 7 is movable along the axis 5 as will be described later on. The tubes 6 and 7 are connected respectively to the liquid fuel pump 10 and to the blower 14 by flexible tubes 15 and 16 respectively.

The outlet 17 from the tube 7 and from the conduit 13 is situated slightly down stream of the injection nozzle 11 and of the ignition electrodes 12. In a zone 18 adjacent to the injection nozzle 11, the tube 7 widens towards its outlet 17, in this instance in the form of a cone of revolution about the axis 5, to resume a cylindrical shape of revolution about the said axis in the zone 19 situated down stream of nozzle 11 with respect to the sense of injection 20.

In its cylindrical portion 19, near to the outlet 17, the conduit 13 has an internal peripheral ring 21 formed of small blades imparting a rotary movement about the axis 5 to the air issuing from it.

The tube 8 defines with the tube 7 a conduit 22 coaxial to the conduit 13 and fixed with respect to the ring 1 and with respect to the boiler. This conduit 22 is used for the injection of the powdered fuel to be burned and to this end, it is connected to any device appropriate for feeding powdered fuel, in this instance a variable speed blower 23. Blower 23 is supplied for example by a worm conveying the fuel from a hopper, itself supplied by grinders when it is a question, for example, of burning waste which is not originally in the form of dust (these elements are not shown herein).

In the vicinity of its outlet 24, the tube 8 departs from its cylindrical shape of revolution about the axis 5 to take on, in a zone 25, a truncated shape of revolution about the axis 5 and converging towards the outlet 24.

Thus, due to the double action of the flared truncated zone 18 of the tube 7 and of the truncated zone 25 of the tube 8, the transverse section of the conduit 22 reduces progressively towards the outlet 24 of the latter. This provides a throttling effect tending to increase the pressure at which the powdered fuel is atomized in the combustion chamber 3.

As the figures show, the tube 8 has a bent end exterior of the boiler. The tubes 6 and 7 extend beyond the said bend passing through the wall of the tube 8 at a zone 26 through a sleeve 27 having an internal cylindrical surface of revolution about the axis 5 and a diameter in the neighbourhood of the outer diameter of the tube 7. Fluid tightness is ensured in this instance by two toric-joints or O-rings 37.

Sliding of the assembly formed by the tubes 6 and 7 with respect to the other elements of the burner along the axis 5, is therefore possible without leaks. The sliding is controlled, for example, by a screw 28 parallel to the axis 5 mounted for rotation in a lug 29 integral with the tube 7 outside the tube 8 and capable of being screwed to a greater or lesser extent into a lug 30 integral with the sleeve 29.

During the course of this translatory movement of the assembly formed by the tubes 6 and 7 along the axis 5, the flared truncated zone 18 of the tube 7 is displaced with regard to the outlet 24 from the conduit 22, producing an increase or decrease in the cross section offered for the passage of powdered fuel.

In the example represented in FIGS. 1 and 2, the movable assembly formed by the two concentric tubes 6 and 7, is represented in its retracted limit position and can only be displaced towards the right in the figures which has the effect of increasing the size of the annular opening 24.

On the other hand, the slope of the flared truncated portion 18 is greater than that of the converging truncated portion 25 which is opposite thereto. The result is that the flow of material passing through this annular throttle has a slightly divergent direction and has a tendency to widen. Moreover when the mobile assembly is displaced towards the right, the flared conical portion 18 projects in front of the converging conical portion 25 which accentuates the widening effect.

Furthermore, as shown in the figures, after the flared zone 18, the tube 7 comprises a cylindrical portion 19 such that the terminal orifice 17 of the tube 7 is situated beyond the annular orifice 24. This facilitates starting and the stability of the flame.

Around the tube 9, the tube 9 defines with the latter, a fixed conduit 31 connected to the same blower 14 as the conduit 13, but through a valve 32.

The tube 9 preserves a cylindrical shape up to its outlet which is situated in the same transverse plane with respect to the axis 5 as the outlet 24 from the tube 8. From the conduit 22, however the conduit 31 widens progressively towards the said outlet due to the converging conicity of section 25 of the tube 8.

At the level of this outlet, the conduit 31 has an annular ring of small vanes 33, comparable with ring 21 with which the conduit 13 is provided but of reverse pitch, so that the air discharging from the conduit 31 rotates about the axis 5 in a sense opposite to the air discharging from the conduit 13. Since the orifice 24 from the conduit 22 does not include such vanes, the result is that the flow of primary air and of fuel, which is laminar, is trapped between two secondary air flows, one internal and the other external, which are whirling and in opposite senses.

The delivery from the air injection conduits is, of course, a function in particular of the material used and of the dimensions of the different burner conduits. However, an injection at the rate of one third of the volume of air injected by the peripheral conduit 31 to two thirds injected by the central conduit 13, is considered to be a generally useful average value. This figure is, of course, given purely as an example.

As is shown in figures, the annular orifice **9*a* from the conduit 9, the annular orifice 24 and the orifice 17 issue into a chamber 34 integral with the tube 9** constituting an expansion and stabilization chamber for the flame.

Preferably, this expansion chamber is cylindrical and has a diameter greater than that of the outer tube 9 to which it is connected by a truncated divergent connection **34*a***.

The outlet orifice 35 from the said chamber 34, is defined by a collar 36, likewise truncated, but convergent.

Preferably, the dimensions of the collar 36 are such that the diameter of the orifice 35 is slightly greater than the diameter of the orifice **9*a***.

Although not shown in the figure, the collar 36 may be removable so that the collar 36 may be replaced by another collar of similar shape but of different dimensions so as to regulate the stability of the flame. Also, the length of the cylindrical portion of the chamber may be modified.

Regulation of the flame is obtained by modifying:

the length of the rectilinear portions of the conduits;

the position of the divergent piece 18 with respect to the convergent piece 25;

the length of the cylindrical portion 19;

the length of the expansion chamber 34;

the dimension of the collar 36;

the speed and the flow of the air in the internal secondary air conduit 13;

the speed and the flow of the air in the external secondary air conduit 31;

the speed and the delivery of the mixture of primary air/materials in the conduit 22.

The length of the rectilinear portions of the conduits is preferably determined so as to provide a stabilized laminar flow and to provide the latter more particularly in the conduit 22.

In fact, it has proved to be distinctly preferable for the primary air to have a laminar flow, since when it does not do so, deposits of materials are produced in the conduit 22 and above all, separation phenomena due to centrifuging of the air and of the powdered products. When this occurs, the flow of primary air plus fuel would no longer be of uniform composition, which produces considerable irregularities within the working conditions of combustion.

Figure 3:
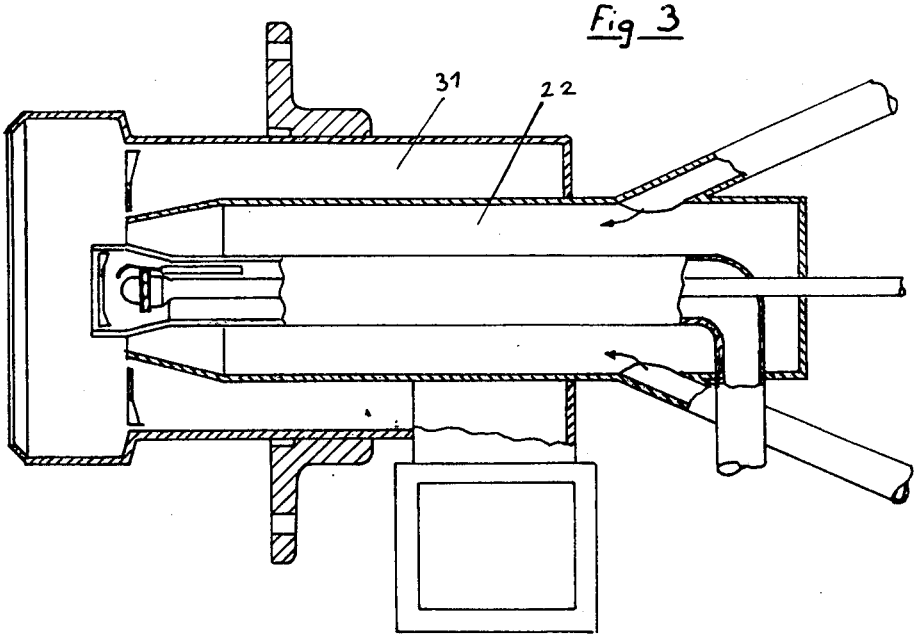
FIG. 3 is a view in elevation and lateral section of a variant of the burner of FIG. 1.

To obtain a laminar flow, the flow of primary air and of materials is preferably divided into a plurality of branches (four in the example shown in FIGS. 3 and 4) which converge obliquely towards the conduit 22. This arrangement avoids the elbow bend at the junction with the said conduit 22 and enables a more laminar flow to be obtained on the interior of the latter.

The secondary air is supplied by two conduits, one conduit 31 which surrounds the conduit 22 externally and a conduit 13 which is located within it.

All these conduits eventually discharge into the chamber 34, called the expansion chamber the purpose of which is to ensure good starting of the flame. Any lift-off of the flame risks causing its extinction.

Figure 5:
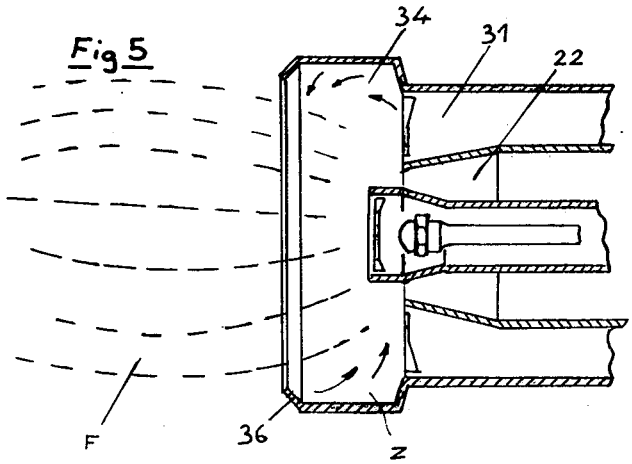
FIG. 5 is a diagrammatic view illustrating the various flows into and through the expansion chamber.

In order to obtain this result it is necessary for the external secondary air to be centrifuged by the vanes 33. Then, this flow of secondary air is rotated in a vortex about the flame F, as shown in FIG. 5, the said flame being located partially inside the chamber 34. The air flow is reflected by the outer lips 36 and it returns towards the rear. On arriving in the zone Z it collides with the arriving flow which forces it to be mixed with the primary air flow and the materials. However, during the course of this rotation about the flame, this secondary air flow is progressively reheated and may arrive at a temperature around 300° to 400° at the instant when it is mixed with the primary air flow and the materials, which assists ignition of the material.

Figure 4:
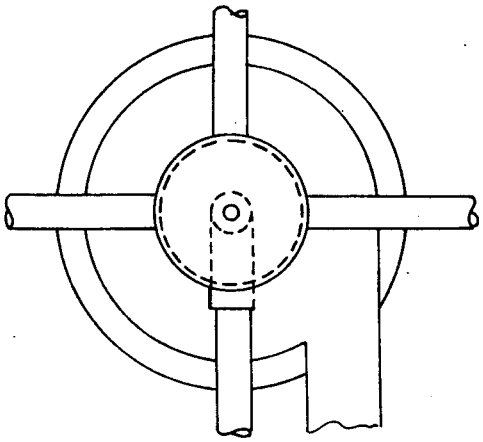
FIG. 4 is a rear view of FIG. 3.

The whirling movement is imparted to this external secondary air flow by the vanes 33. However it has proved advantageous to supply the said air through a spiral conduit as shown in FIG. 4 so that the said air flow is already propelled by a helicoidal movement before arriving at the vanes 33, which again accelerate the said rotary movement.

The position of the divergent piece 18 with respect to the convergent piece 25 has the effect of controlling the widening effect. When the parts are in the position shown in the figures, the flame is long and narrow. As the flared portion 18 is advanced with respect to the truncated portion 25, the flame becomes shorter and wider.

The length of the cylindrical portion 19 determines the position of the orifice 17 with respect to the plane of the annular orifices 24 and 9a, which has an influence on the stability and starting of the flame.

The length of the expansion chamber also has an influence on the stability and starting of the flame as well as the dimensions of the collar 36.

The speed and the delivery of the air and of the injected powdered fuels can, of course, be varied to a large extent, particularly as a function of the nature of the burnt fuel. In the case of wood, it was apparent that a proportion of twelve cubic meters of air per kilo of burnt wood gave, satisfactory results. It was also apparent in tests that it was preferable to maintain the speed of injection of the powdered fuel lower than about 15 meters per second so as to facilitate ignition, this figure, like the preceding figure, being given simply by way of an example and varying in accordance with the materials burned.

As far as the proportions of air in the respective conduits are concerned, good results have been obtained with sawdust by employing four volumes of air in the conduit 13 for two volumes of air in the conduit 31 and three volumes of air in the conduit 22 for transporting the product to be burned.

The ignition cycle for a burner such as that just described is, for example, the following:

(1) Starting up the blower 14 for feeding secondary air at full rate and operating for about one minute so as to ventilate the conduits.

(2) After a minute, the blower 14 is returned to the speed corresponding to the supply of air to the burner 11 for liquid fuel.

(3) The liquid fuel pump is then started, but the electro valve permitting supply to the nozzle remains closed.

(4) The electrodes 12 have voltage applied to them for a brief period (about 10 seconds).

(5) The electro valve for supplying the nozzle is opened, the latter is fed and the liquid fuel is ignited.

(6) Ignition is controlled by a photoelectric cell associated with a timing circuit (neither of which is shown) which controls the complete stoppage if ignition is not effected within the 10 seconds.

(7) Proceed at a low rate for the secondary air blower 23 without feeding fuel.

(8) Preceeding at a slow rate for the fuel feeding device so that the burner is supplied by a primary air flow plus fuel at a low rate. This flow is ignited on contact with the flame at the liquid fuel burner.

(9) Proceed up to full power. During the course of this phase, the blower 23 and the fuel feed device are progressively accelerated, such that the primary air delivery plus fuel increases progressively up to the maximum rate in a time "t".

During the first half of this time "t", the speed of the secondary air blower remains constant and during the second half this speed increases until its maximum is reached so that at the end of the time "t", the primary air plus fuel deliveries on the one hand and secondary air on the other hand are both maximum.

(10) The supply of liquid fuel is maintained for a brief period (about 30 seconds) after the said supplies have reached their maximum values.

(11) The electro valve for supplying liquid fuel is closed and the liquid fuel pump likewise are closed.

(12) A second photoelectric cell (not shown) controls the presence of the flame permanently throughout the operation of the burner.

The shutting down cycle, whether that be caused voluntarily or by a safety device is as follows:

1—The device for feeding powdered fuel is stopped.

2—Primary air arrives only for a period of time sufficient to scavenge the conduit 22.

3—The flame is extinguished.

4—After extinction, the blowers continue to turn for about 30 minutes so as to ensure cooling of the entire installation.

Thus, these ignition and extinction cycles, impart security of operation whilst avoiding any arrival of fuel which is not immediately burned and thus any risk of explosion when subsequently re-igniting.

Preferably, a device for feeding material which ensures a good distribution of the latter, is arranged upstream of the primary air blower. The most satisfactory results are obtained by a device producing fluidizing of the material since each particle is then entrained within a bubble of air and a more homogeneous mixture of the particles and of the primary air is obtained and a better yield from the burner, the economy thus realized being of the order of 20 percent.

Also, the air fluidizing circuit is preferably a hot air circuit so as to obtain perfect drying. However, this air need not be heated to high temperatures since its object is not to facilitate ignition of the particles but essentially their drying.

The burner in accordance with the present invention can operate using as fuel any solid combustible material previously reduced to particles, that is to say, waste flax roots, cardboard or paper waste, waste sheep skin combings, waste straw, dead leaves, vine twigs, kernels and shells of fruits.

The size of the particles is of the order of 300 microns, this dimension being given by way of example and being capable of variation in accordance with the nature of the fuel.

The burner just described comprises two secondary air conduits coaxial with the primary air conduit. This arrangement is that which provides the best results, however, it is possible to operate the burner without internal secondary air, although that involves a reduction in efficiency of combustion, the proportion of unburnt substances possibly being 15 percent to 20 percent.

The particles are not only instanteanously burnt but in addition totally burnt and the result of that is that the amount of ashes present in the exhaust gases is very low, which is specially advantageous as for as air-pollution is concerned.

What we claim is:

1. A burner for powdered fuel comprising an annular conduit for the injection of solid fuel in powder from entrained in air, a first conduit coaxial with and internal to said annular conduit and a second conduit coaxial with and external to said annular conduit, each of said first and second conduits having air supplied thereto, means forming a chamber, each of said three conduits having an end for discharging the flow therefrom into said chamber where the flows are mixed, means at the discharge end of said annular conduit for producing a substantially laminar or somewhat convergent flow of the fuel into said chamber, and means at the respective discharge ends of each of said first and second conduits for producing a vortex flow of air into said chamber.

2. A burner as in claim 1 wherein said means forming said chamber comprises a diverging truncated conical section connected to the discharge end of said second conduit, a cylindrical central section and a terminal converging truncated conical section, the air from said second conduit being rotated by the walls of the chamber and reflected back toward the end of the annular conduit by the terminal converging section.

3. A burner according to claim 1 wherein the means at the end of the annular conduit for the injection of fuel in suspension in air produces a convergent flow.

4. A burner according to claim 1 wherein the means at the respective ends of said first and second air injection conduits comprise vanes of inverse pitch so that the central flow of fuel in suspension is arranged between two vortices of inverse sense.

5. A burner according to claim 1 wherein the annular conduit comprises a straight line section discharging into the expansion chamber and a plurality of convergent oblique conduits symmetrical with respect to the axis of the burner supplying fuel to said straight line section such that the flow of primary air is laminar.

6. A burner according to claim 1 further comprising a spiral chamber for said second conduit to increase the degree of whirling movement of the said air flow from the second conduit.

7. A burner according to claim 1 wherein the end of the first conduit discharges into said chamber in a plane situated downstream of the plane in which are situated the discharge end of the annular conduit and the discharge end of the first conduit.

8. A burner as in claim 2 further comprising a third conduit for liquid fuel for ignition of the powder fuel, said third conduit being coaxial with and interior of the first conduit and movable therewith.

9. A burner according to claim 1 further comprising a variable speed and volume blower means for controlling the flow of air transporting the powdered fuel.

10. A burner according to claim 1 further comprising means for controlling the quantity of air discharged into the chamber by the first conduit to be greater than the quantity of air discharged by the second conduit.

11. A burner according to claim 10 in which the total quantity of discharged air is divided in the ratio of 2/3 in the first conduit and 1/3 in the second conduit.

12. A burner according to claim 1 further comprising a third conduit for liquid fuel for ignition of the powder fuel, said third conduit being coaxial with and interior of the first conduit.

13. A burner according to claim 12 further comprising valve means for the second conduit which is closed when the conduit for the ignition liquid fuel is being supplied, so that only air from the internal first conduit is supplied.

14. A burner for powdered fuel comprising an annular conduit for the injection of solid fuel in powder form entrained in an air stream, a first conduit coaxial with and internal to said annular conduit and a second conduit coaxial with and external to said annular conduit, each of said first and second conduits having air supplied thereto, means forming a chamber, each of said three conduits having an end for discharging the flow therefrom into said chamber, said means forming said chamber including a divergent truncated portion connected to the end of said second conduit, a central cylindrical portion and a terminal converging portion, said end of said annular conduit being convergent, and located between the ends of said first and said second conduits.

15. A burner as in claim 14 further comprising means for moving said annular and said first conduits longitudinally relative to each other to control the flow of air fuel from said annular conduit.

16. A burner according to claim 15 wherein the diverging slope of the wall of the first conduit is greater than the converging slope of the wall of the annular conduit.

17. A burner according to claim 16 in which the divergent portion of the first conduit is extended by a cylindrical portion the extremity of which constitutes the extremity of the first conduit.

18. A burner according to claim 17 in which the length of the said cylindrical portion is determined in accordance with desired combustion characteristics of the burner.

19. A burner according to claim 15 in which the length of the central cylindrical portion of the chamber is determined in accordance with desired combustion characteristics of the burner.

20. A burner according to claim 15 in which the dimensions of the terminal truncated convergent portion of the chamber are determined in accordance with desired combustion characteristics of the burner.

21. A burner according to claim 14 wherein the annular conduit supplied with the powdered fuel by fluidizing the fuel in an air stream.

22. A burner according to claim 21 in which the fluidizing air is hot air.

* * * * *